US005501188A

United States Patent [19]

Fukuoka

[11] Patent Number: 5,501,188

[45] Date of Patent: Mar. 26, 1996

[54] ENGINE STARTER MOUNTING ARRANGEMENT

[75] Inventor: Yoshihito Fukuoka, Hamamatsu, Japan

[73] Assignee: Sanshin Kogyo Kabushiki Kaisha, Hamamatsu, Japan

[21] Appl. No.: 301,327

[22] Filed: Sep. 6, 1994

[30] Foreign Application Priority Data

Sep. 3, 1993 [JP] Japan ..... 5-269398

[51] Int. Cl.[6] ..... F02N 11/00

[52] U.S. Cl. ..... 123/179.25; 123/195 E

[58] Field of Search ..... 123/179.25, 179.26, 123/195 A, 195 E, 647

[56] References Cited

U.S. PATENT DOCUMENTS

| | | | |
|---|---|---|---|
| 1,191,624 | 7/1916 | Stevens | 123/195 E |
| 1,727,086 | 9/1929 | Vastano | 123/179.26 |
| 2,731,005 | 1/1956 | Lausen | 123/179.25 |
| 3,022,778 | 2/1962 | Stemen | 123/195 E |
| 4,507,566 | 3/1985 | Leatherman et al. | 123/179.25 |

*Primary Examiner*—Andrew M. Dolinar
*Attorney, Agent, or Firm*—Knobbe, Martens, Olson & Bear

[57] ABSTRACT

An outboard motor having a starter motor and other electrical components which are mounted adjacent the crankcase of the engine but in spaced relationship thereto by a mounting plate for providing heat insulation.

15 Claims, 6 Drawing Sheets

ENGINE STARTER MOUNTING ARRANGEMENT

BACKGROUND OF THE INVENTION

This invention relates to an engine starter mounting arrangement, and more particularly to an improved engine starter mounting arrangement particularly adapted for use with an outboard motor.

It is well known to employ electric starter motors for starting of internal combustion engines. Typically, the engine flywheel is provided with a ring gear, and a starter motor is mounted to the side of the engine and has a pinion gear which is, when energized, shifted into driving relationship with the flywheel starter gear for starting the engine. Normally the starter motor is mounted either on the cylinder block, flywheel housing, or crankcase so as to be positioned in proximity to the flywheel. However, in certain applications for internal combustion engines, such mountings can present some difficulties.

For example, when the engine is employed in conjunction with an outboard motor, the engine is normally mounted, as is typical with outboard motor practice, with its crankshaft rotatable about a vertically extending axis. Therefore, with outboard motor applications, it has been the practice to mount the starter motor directly on the crankcase, because this is an area within the protective cowling of the power head that is normally open. However, because of the compact nature of the power head of outboard motors and the fact that the engine is contained within a protective cowling through which only minimum air flows for the combustion of the engine and not primarily for cooling, the starter tends to be overheated due to its direct contact with the crankcase chamber of the engine. Therefore, premature starter failures may occur.

It is, therefore, a principal object of this invention to provide an improved engine starter mounting arrangement, particularly adapted for use with outboard motors.

It is a further object of this invention to provide an engine starter mounting arrangement for an outboard motor, wherein the starter motor may be mounted adjacent the crankcase, but is separated from it by a cooling air gap to minimize heat transmission between the engine and the starter motor.

SUMMARY OF THE INVENTION

This invention is adapted to be embodied in an internal combustion engine having a cylinder block with a crankcase affixed to one end thereof and in which an engine output shaft rotates. A flywheel is affixed to the engine output shaft and extends adjacent one end face of the crankcase. A mounting plate is affixed to the crankcase in spaced relationship thereto for defining a cooling air gap therebetween. A starter motor is mounted on the mounting plate and has a pinion gear that is adapted to be brought into engagement with the flywheel for starting of the engine.

DETAILED DESCRIPTION OF THE PREFERRED EMBODIMENT OF THE INVENTION

Figure 1:
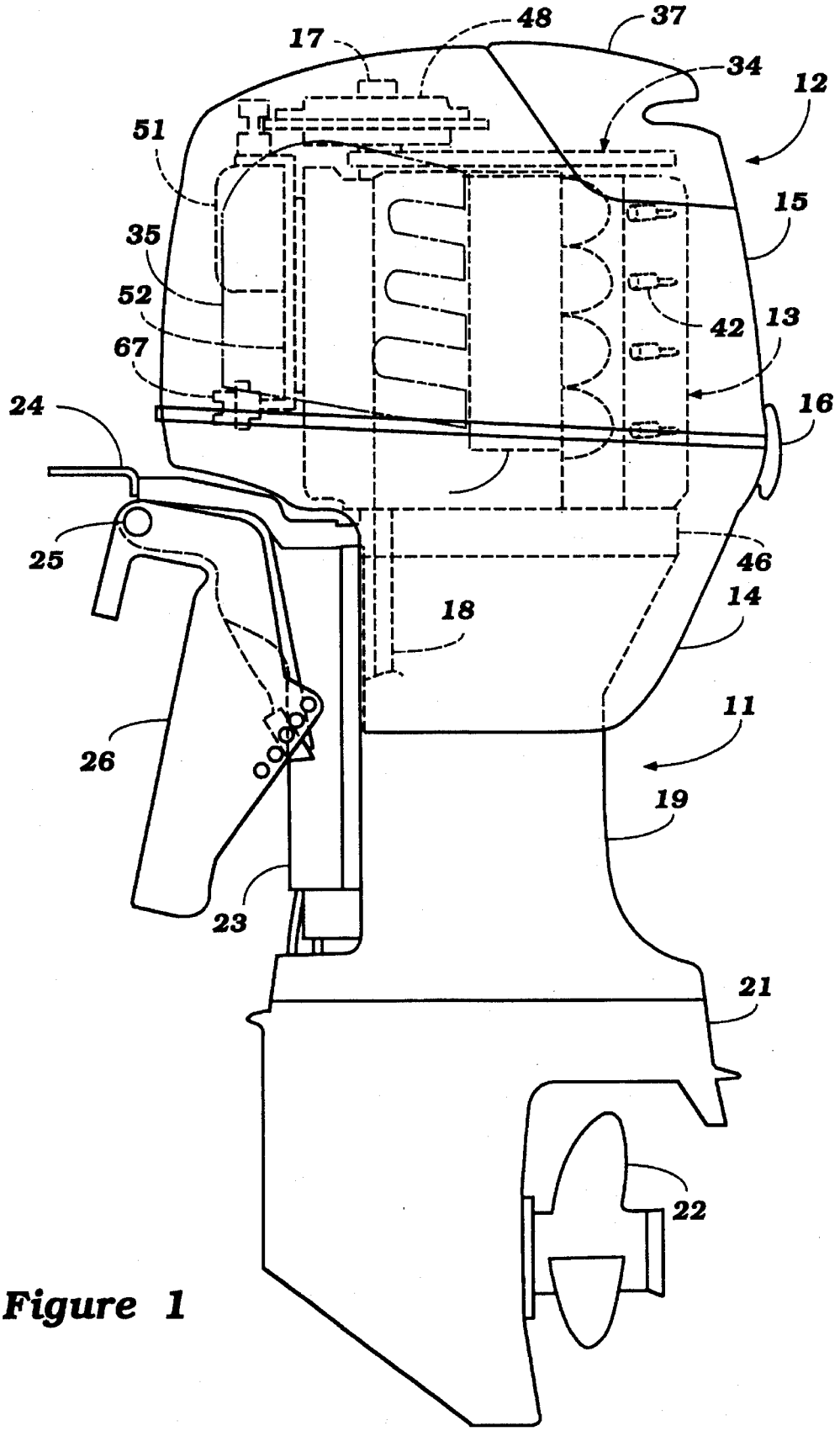
FIG. 1 is a side elevational view of an outboard motor constructed in accordance with an embodiment of the invention.

Referring first to FIG. 1, an outboard motor constructed in accordance with an embodiment of the invention is identified generally by the reference numeral 11. The invention is described in conjunction with an outboard motor because it has particular utility with such applications, for reasons already noted and which will be discussed in more detail below. However, it should be readily apparent to those skilled in the art that the invention may also be employed in conjunction with other applications for internal combustion engines, particularly those where the engine is mounted with its output shaft extending vertically and/or when the engine is mounted in a confined relationship and wherein heat transfer to the starter motor may present particular problems.

The outboard motor 11 includes a power head, indicated generally by the reference numeral 12, which is comprised of a powering internal combustion engine, indicated generally by the reference numeral 13, and a surrounding protective cowling comprised of a lower tray member 14 and an upper main cowling member 15 that is detachably connected to the tray portion 14 by means which include a releasable clamp or latch 16.

As is typical with outboard motor practice, the engine 13 is mounted so that its output shaft, a crankshaft 17, rotates about a vertically extending axis so as to be coupled to a vertically extending drive shaft 18 that is journaled in a drive shaft housing 19 which depends the power head 12 and which terminates at a lower unit 21. The drive shaft 18 extends into the lower unit and drives a propeller 22 through a normal forward/neutral/reverse transmission (not shown).

A steering shaft (not shown) is affixed to the drive shaft housing 19 in a known manner and is journaled for steering motion about a vertically extending steering axis within a swivel bracket 23. A tiller 24 is affixed to the upper end of this steering shaft and may be operated in any known manner for steering of the outboard motor 11 about the steering axis defined by the swivel bracket 23.

The swivel bracket 23 is, in turn, connected by means of a pivot pin 25 to a clamping bracket 26 that is adapted to be affixed to a transom of an associated watercraft (not shown) in a well-known manner. The pivotal movement about the pivot pin 25 may be employed for achieving trim adjustment of the outboard motor 11 and for tilting up of the outboard motor so that the propeller 22 will be disposed above the level of the water in which the associated watercraft is operating, in a well-known manner.

As has been noted, the foregoing description of the outboard motor 11 has been primarily for orientation purposes, and the particular construction of the outboard motor per se forms no part of the invention. As has been noted, however, the invention does have particular utility in conjunction with outboard motors because of the particular problems which they present with respect to the location and operation of the electric starter mechanism for the engine 14. This structure will now be described in more detail by reference to the remaining figures.

Figure 2:
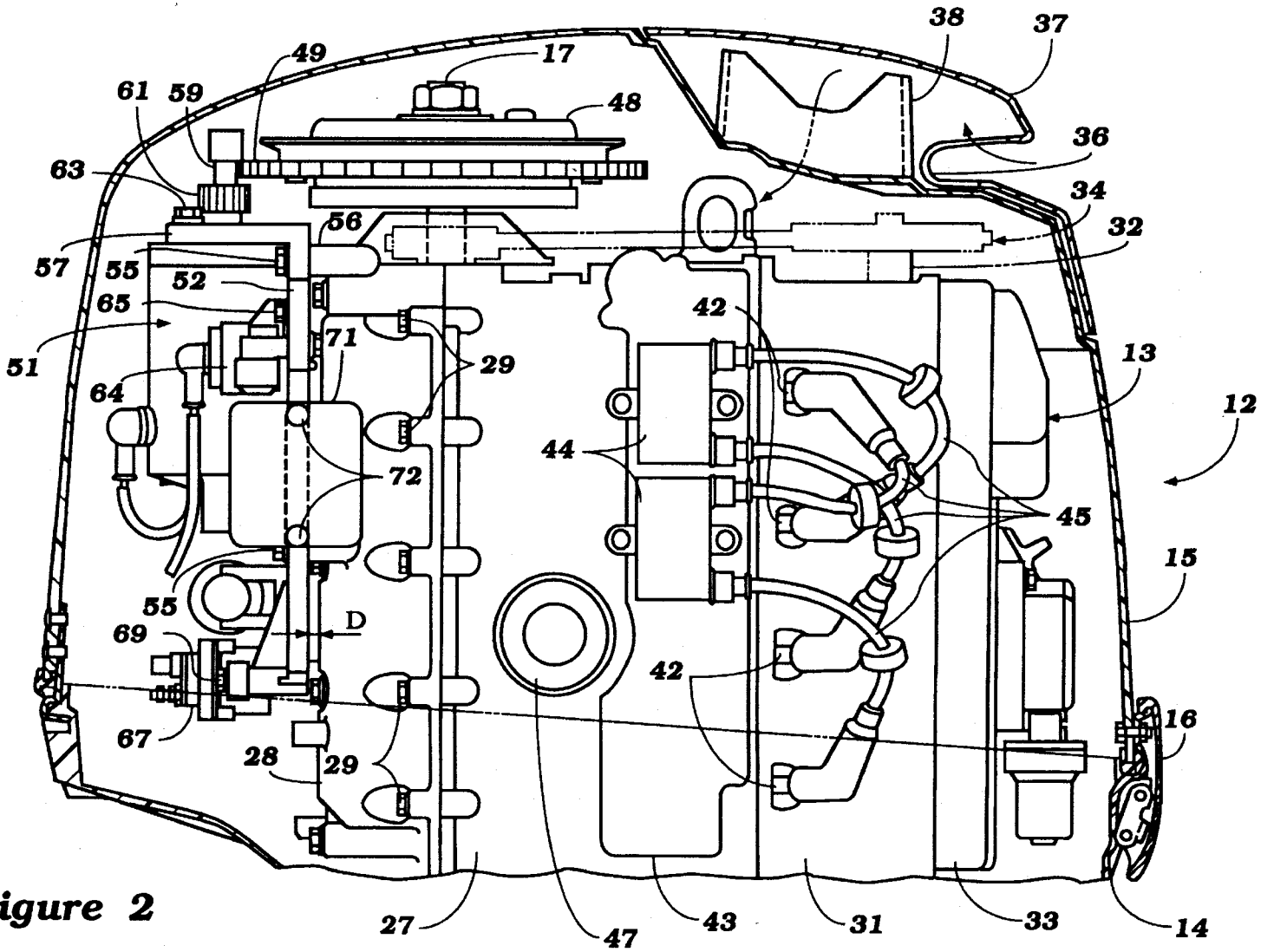
FIG. 2 is an enlarged side elevational view of the power head of the outboard motor, with the protective cowling broken away and shown in section so as to more clearly show the components associated with the engine.
Figure 3:
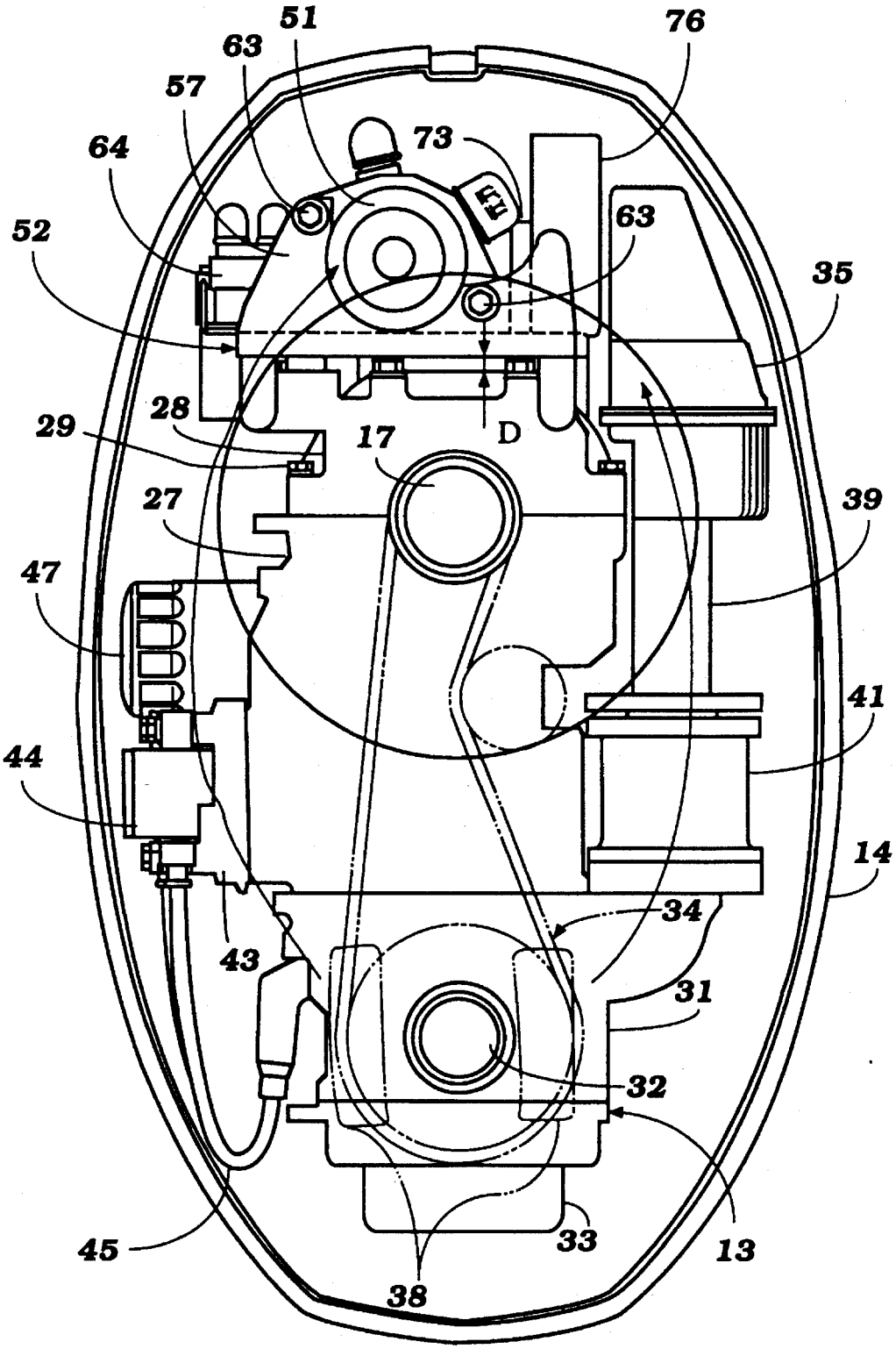
FIG. 3 is a top plan view of the power head, with the upper main cowling portion removed.

Referring first primarily to FIGS. 2 and 3, the engine 13 is comprised of a cylinder block 27 in which a plurality of cylinder bores are formed. Since the crankshaft 17 rotates about a vertically disposed axis, the cylinder bores formed in the cylinder block 27 have their axes substantially horizontally disposed and are spaced one vertically above the other. Although the invention is described in conjunction with an in-line type of engine, it should be readily apparent to those skilled in the art that the invention may be equally as well-practiced with engines having other cylinder numbers and other cylinder configurations such as V-type, opposed, etc.

The cylinder bores contain pistons that are connected by connecting rods to drive the crankshaft 17 in a well-known manner. Since the invention deals primarily with the arrangement for starting of the engine, the internal details of the engine 13 are not necessary to understand the construction and operation of the invention. Therefore, where any detail of the engine 13 is not described, it may be considered to be conventional.

The crankshaft 17 is rotatably journaled within a crankcase chamber that is formed by the skirt of the cylinder block 27 and a crankcase member 28 that is detachably connected to the cylinder block 27 in a known manner, including fasteners 29.

A cylinder head, indicated generally by the reference numeral 31, is affixed to the cylinder block 27 at the end opposite the crankcase member 28. In the illustrated embodiment, the cylinder head 31 is disposed to the rear of the outboard motor, while the crankcase member 28 is disposed to the front of the outboard motor. Again, this is an orientation that is normally used in conjunction with fourcycle engines in outboard motors, but it will be apparent to those skilled in the art that the particular orientation is a matter of design choice.

In the illustrated embodiment, the engine 13 employs a single overhead camshaft that operates valves in the cylinder head assembly 31 for controlling the intake and exhaust to the individual combustion chambers of the engine. To this end, a single overhead camshaft 32 is rotatably journaled within the cylinder head 31 in a known manner and is confined within a cam chamber that is closed by a cam cover 33 in a known manner. A drive belt 34 drives the crankshaft 32 at one-half crankshaft speed, and this drive arrangement is disposed on the upper side of the engine.

The induction system for the engine 13 includes an air inlet device 35 which is positioned on one side of the engine adjacent the crankcase member 28. This air inlet device 35 draws atmospheric air in from the interior of the protective cowling. Specifically, the main cowling member 15 is provided with a rearwardly facing air inlet opening 36 which is defined in part by a cover piece 37 that is affixed to the main cowling member 15 in a well-known manner. The main cowling member is provided with a pair of upstanding inlet openings 38 so as to provide a tortuous air flow path from the atmospheric air inlet opening 36 to the interior of the protective cowling in the path shown by the arrows in FIG. 2. This acts to separate water particles from the inducted air and permit them to drain back to the body of water in which the watercraft is operating, in a manner known in this art.

The inlet device 35 provides a silencing function and then delivers the intake air to a plurality of intake pipes 39 which extend along the same side of the engine adjacent the cylinder block 27 and which terminate at charge formers, such as carburetors, 41 which, in turn, supply the charge to the induction system formed integrally in the cylinder head 31 and which terminates at the respective intake valve. Although the invention is described in conjunction with an engine having carburetors 41, it should be readily apparent that the form of charge-forming system for the engine is independent of the inventive features which will be described later. Said another way, the invention may be employed with engines having any type of charge-forming system in addition to that specifically described.

The charge which is admitted to the combustion chambers of the engine is then fired by means of spark plugs 42 that are mounted on one side of the cylinder head 31 and which have their spark gaps extending into the combustion chambers. The spark plugs 42 are fired under the control of an ignition circuit to be described. This ignition system energizes spark coils 44 mounted on the side of the cylinder block 27 opposite the induction system on an exhaust plate 43 to generate a high voltage that is transmitted to the spark plugs 42 through ignition wires 45 in a known manner.

The exhaust system for the engine 13 is contained primarily integrally within the cylinder head 31 and cylinder block 27, as is typical with outboard motor practice. The exhaust gases are then discharged downwardly through a spacer plate 46 (FIG. 1) upon which the engine 13 is mounted into the drive shaft housing 19 and lower unit 21 for discharge to the atmosphere through the body of water in which the watercraft is operating, in a well-known manner. As has been noted, these components of the engine may be considered to be conventional, and a further description of them is not necessary to permit those skilled in the art to practice the invention.

Figure 4:
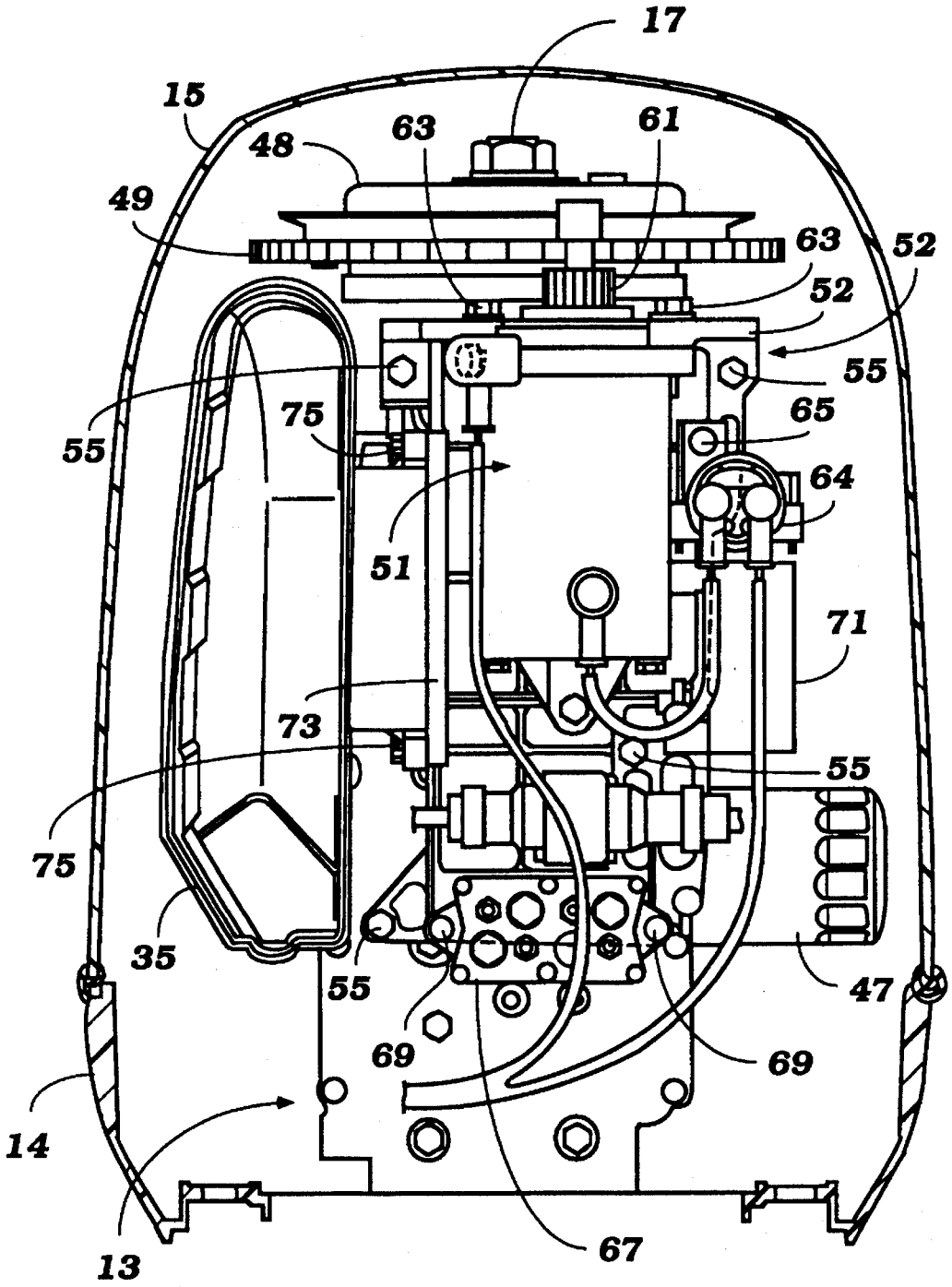
FIG. 4 is a front elevational view of the power head, with the protective cowling broken away and shown in phantom.
Figure 5:
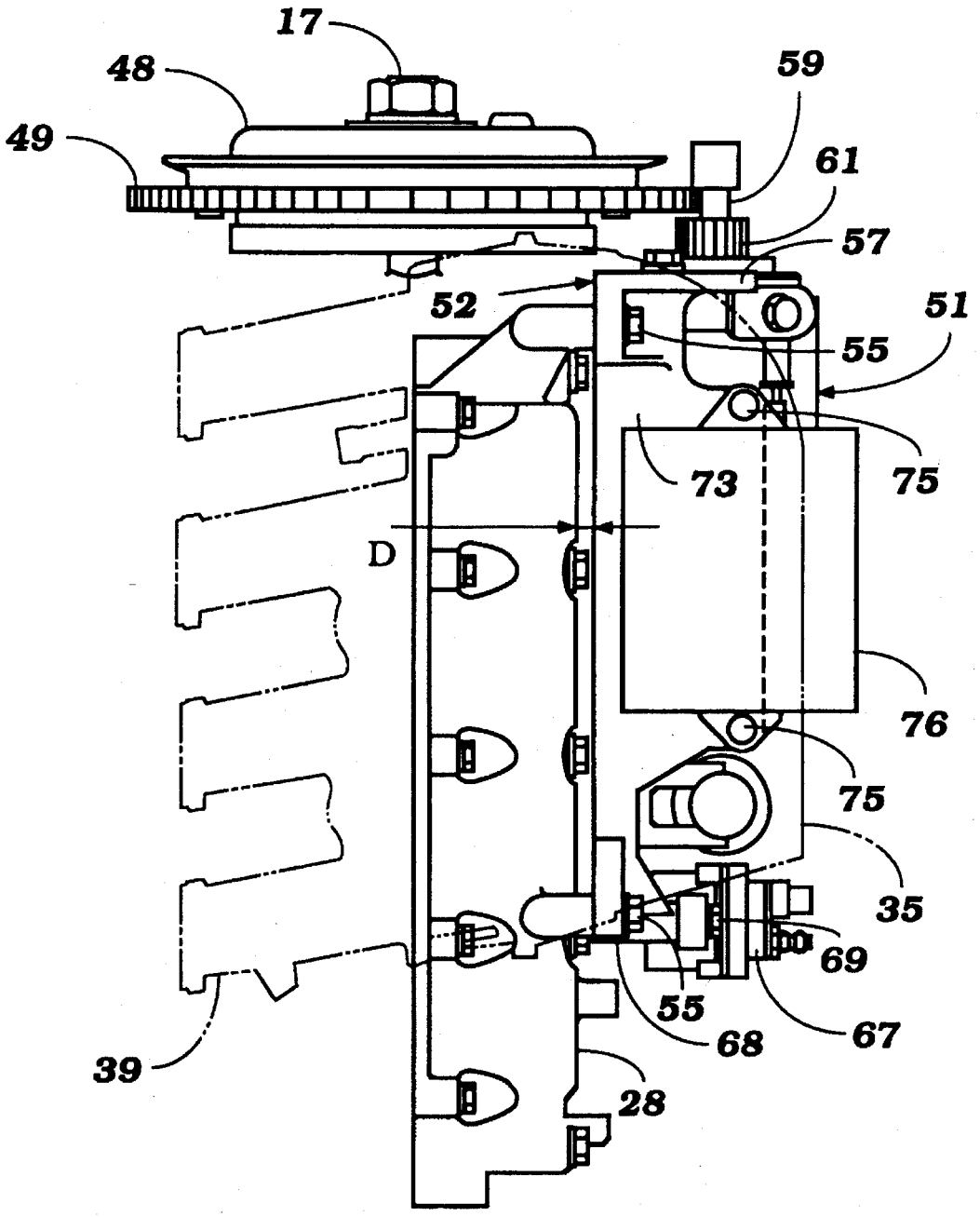
FIG. 5 is an enlarged side elevational view, looking in the direction opposite of FIG. 1, and shows only the starter mechanism and mounting portions therefor in solid lines with the induction system being shown in phantom.

The engine 13 is also provided with a lubricating system, and this includes an oil filter 47 (FIGS. 2–4) that is mounted on one side of the cylinder block 27 and through which lubricant is circulated in any known manner for lubrication of the engine components.

The ignition system for the engine 13, in addition to those components already described, includes a flywheel magneto assembly 48 that is affixed in a known manner to the upper end of the crankshaft 17 and above the cam drive belt 34. As is typical, a starter gear 49 is affixed to the outer end of the flywheel 48 and cooperates with a starter mechanism, now to be described, for starting of the engine 13.

Figure 6:
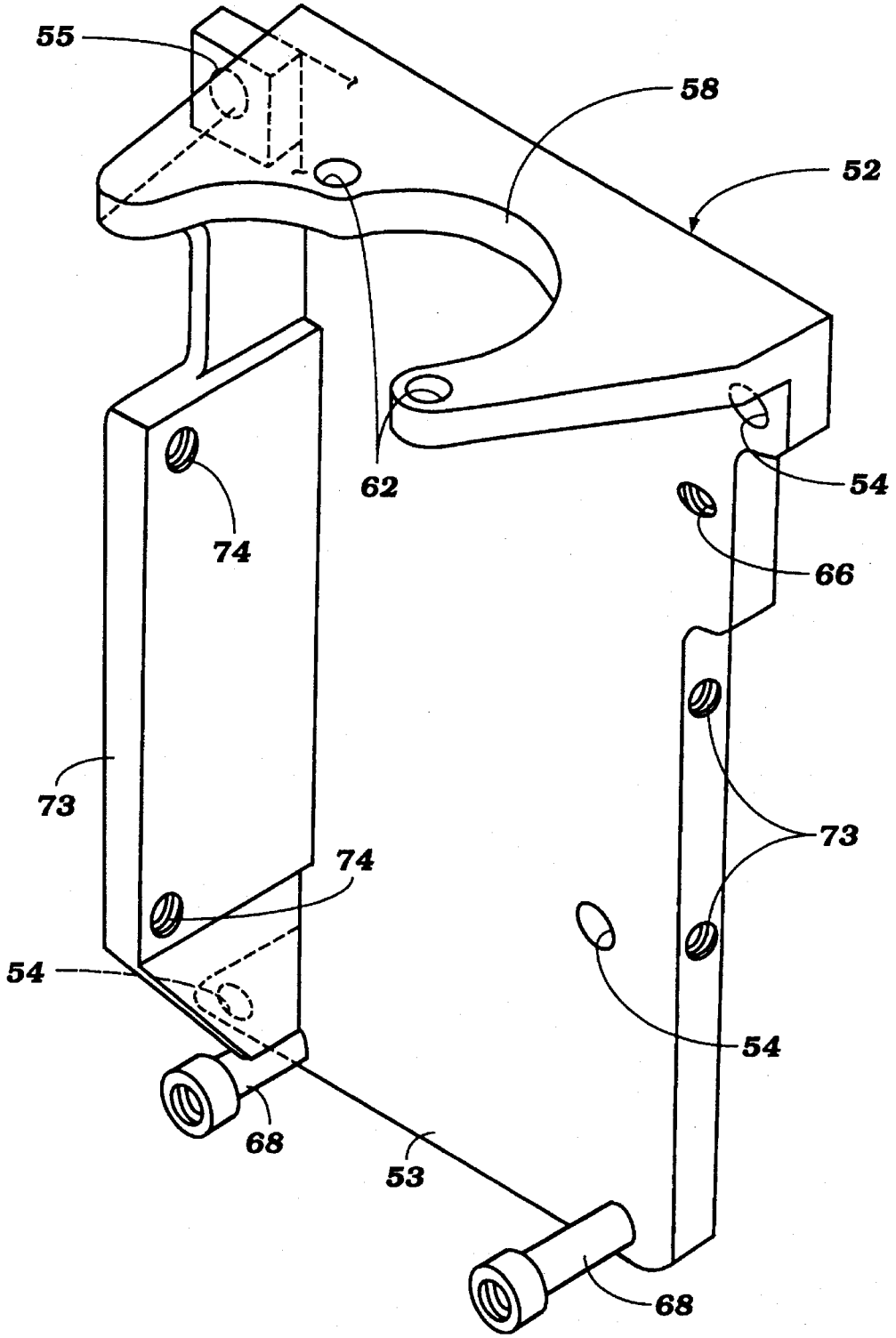
FIG. 6 is an enlarged perspective view of the starter mounting plate.

It should be noted that the side of the protective cowling, and particularly the main cover member 15 adjacent the crankcase 28, is relatively free and open. Therefore, it is the practice to mount a starter motor, indicated generally by the reference numeral 51, in this area for cooperation with the starter gear 49 of the flywheel 48 for starting of the motor 13. However, if the starter motor 51 is mounted directly on the crankcase member 28, as was heretofore the practice, then a large amount of the engine heat would be transmitted to the starter motor 51, and accordingly, the starter motor 51 might be subject to premature failure. In accordance with the invention, the starter motor 51 is mounted on a mounting plate assembly, indicated generally by the reference numeral 52 and which is shown alone in perspective view in FIG. 6 and which also appears in the remaining figures. This mounting plate assembly 52 is constructed and arranged in such a way as to maintain an air gap, indicated by the dimension D, between it and the crankcase member 28, which air gap serves the purpose of providing insulation. In addition, since the starter motor 51 is mounted on the side away from this air gap, further heat protection is achieved.

The mounting plate 52 has a first generally planar portion 53 that is provided with a plurality of bored openings 54 that are adapted to pass threaded fasteners 55, which are, in turn, threaded into tapped openings formed in bosses 56 formed on the crankcase member 28 so as to affix the mounting plate assembly 52 to the crankcase member 28 and establish the air gap D. The upper end of the plate portion 53 is formed with a horizontally extending plate portion 57 that is formed with an arcuate cutout 58 so as to pass the starter motor output shaft 59 to which a pinion gear 61 is rotatably coupled by means of a mechanism. This mechanism which causes axial movement of the starter gear 61 from its normal non-driving position, as shown in FIG. 2, into a position in engagement with the starter gear of the flywheel 58 when the starter motor 51 is energized for starting of the engine in a well-known manner. The horizontal plate portion 57 is formed with a pair of openings 62 that receive threaded fasteners 63 that are tapped into openings in the housing of the starter motor 51 so as to affix the starter motor 51 to the mounting plate 52.

The starter motor 51 is energized by a starter relay 64, which is mounted on the mounting plate 52 to the side of the starter motor 51 by means of a fastener 65 that is threaded into a tapped opening 66 formed in the plate portion 53 of the mounting plate 52.

In addition to mounting of the starter motor 51 and its relay 64 on the mounting plate 52 in the spaced relationship to the crankcase member 28, a number of other electrical components are so mounted by the plate 52 so as to provide effective heat insulation.

These components include a PTT relay 67, which is mounted on a pair of set-off supporting posts 68 having tapped openings in which threaded fasteners 69 are received so as to mount the PTT relay in further spaced relationship relative to the crankcase member 28 for further heat protection.

A voltage regulator 71 for the charging circuit of the engine 13 is mounted on the side of the plate portion 53 by means of threaded fasteners 72 that are threaded into tapped openings 73 formed in the side of the plate portion 53. This places the regulator 71 in spaced relationship to one side of the crankcase member 28 so as to further afford heat isolation and insulation.

On the side of the mounting plate 52 opposite to where the regulator 71 is mounted and at one side of the plate portion 53, there is formed a further plate portion 73 having a pair of tapped openings 74. Threaded fasteners 75 secure the CDI ignition circuit 76 for firing the spark coils 42 to this side of the mounting plate assembly 52. As a result, the CDI circuit 76 is also mounted in spaced relationship to the engine 13 and away from the crankcase member 28 so as to ensure that all electrical components are not only securely mounted, but also are mounted in such a way that they will be insulated from the heat of the engine, so as to maintain optimum performance and long life.

It should be readily apparent from the foregoing description that the described construction provides not only effective mounting for the starter motor for the engine in close proximity to the crankcase but also in spaced heat insulating relationship to it, but also mounting of other critical components of the electrical circuit in a secure and yet heat-insulated fashion. Of course, the foregoing description is that of a preferred embodiment of the invention, and various changes and modifications may be made without departing from the spirit and scope of the invention, as defined by the appended claims.

I claim:

1. An internal combustion engine having a cylinder block, a crankcase member affixed to one end of said cylinder block, an output shaft rotatably journaled by said engine and having a starter gear affixed thereto in exposed relationship at one side of said engine, a mounting plate mounted in spaced relationship to said crankcase member and on the side thereof opposite to said cylinder block for defining a cooling air gap therebetween, and a starter motor mounted on said mounting plate on the side of said mounting plate facing away from said crankcase member and operably engaged with said engine output shaft starter gear for effecting electrical starting of said engine.

2. An internal combustion engine having a cylinder block, a crankcase member affixed to one end of said cylinder block, an output shaft rotatably journaled by said engine and having a starter gear affixed thereto in exposed relationship at one side of said engine, a mounting plate mounted in spaced relationship to said crankcase member for defining a cooling air gap therebetween, and a starter motor mounted on said mounting plate on a side thereof said mounting plate being spaced from said crankcase member by bosses formed on one of the mounting plate and crankcase member and operably engaged with said engine output shaft starter gear for effecting electrical starting of said engine.

3. An internal combustion engine as set forth in claim 2, wherein the engine is mounted with its output shaft extending along a vertical axis and wherein the starter gear is affixed on the upper side of the engine.

4. An internal combustion engine as set forth in claim 3, further including a protective cowling encircling the engine and starter motor.

5. An internal combustion engine as set forth in claim 4, wherein the mounting plate is spaced from the crankcase member by bosses formed on one of the mounting plate and crankcase members.

6. An internal combustion engine as set forth in claim 4, further including at least one additional electrical component for the engine mounted on the mounting plate in spaced relationship to the crankcase member.

7. An internal combustion engine as set forth in claim 6, wherein the additional electrical component comprises a starter solenoid for energizing the starter motor.

8. An internal combustion engine as set forth in claim 6, wherein the additional electrical component comprises a voltage regulator.

9. An internal combustion engine as set forth in claim 6, wherein the additional electrical component comprises a CDI ignition circuit for firing spark plugs of the engine.

10. An internal combustion engine as set forth in claim 6, wherein at least one of the additional electrical components is mounted on a side of the mounting plate in spaced relationship to the crankcase member.

11. An internal combustion engine having a cylinder block, a crankcase member affixed to one end of said cylinder block, an output shaft rotatably journaled by said engine and having a starter gear affixed thereto in exposed relationship at one side of said engine, a mounting plate mounted in spaced relationship to said crankcase member for defining a cooling air gap therebetween, a starter motor mounted on said mounting plate and operably engaged with said engine output shaft starter gear for effecting electrical starting of said engine, at least one additional electrical component for the engine mounted on a side of the mounting plate facing away from the crankcase member.

12. An internal combustion engine as set forth in claim 11, wherein the additional electrical component comprises a starter solenoid for energizing the starter motor.

13. An internal combustion engine as set forth in claim 11, wherein the additional electrical component comprises a voltage regulator.

14. An internal combustion engine as set forth in claim 11, wherein the additional electrical component comprises a CDI ignition circuit for firing spark plugs of the engine.

15. An internal combustion engine as set forth in claim 11, wherein at least one of the additional electrical components is mounted on a side of the mounting plate in spaced relationship to the crankcase member.

* * * * *